US005540855A

United States Patent [19]

Baillely et al.

[11] Patent Number: 5,540,855

[45] Date of Patent: Jul. 30, 1996

[54] PARTICULATE DETERGENT COMPOSITIONS

[75] Inventors: Gerard M. Baillely, New Castle Upon Tyne; Michael A. J. Moss, Prudhoe; Carole P. D. Wilkinson, Whitley Bay, all of Great Britain

[73] Assignee: The Procter & Gamble Company, Cincinnai, Ohio

[21] Appl. No.: 417,706

[22] Filed: Apr. 6, 1995

Related U.S. Application Data

[63] Continuation of Ser. No. 137,141, filed as PCT/US92/03286, Apr. 21, 1992, abandoned.

[30] Foreign Application Priority Data

Apr. 23, 1991 [GB] United Kingdom ..... 9108639

[51] Int. Cl.[6] ..... C11D 3/08; C11D 3/12; C11D 7/20

[52] U.S. Cl. ..... 510/276; 510/360; 510/361; 510/531; 510/533; 510/511; 510/469; 510/444

[58] Field of Search ..... 252/135, 89.1, 252/156, 174, 174.21, 174.22, 174.19; 264/118, 140

[56] References Cited

U.S. PATENT DOCUMENTS

| | | | |
|---|---|---|---|
| 4,664,839 | 5/1987 | Rieck | 252/175 |
| 4,814,095 | 3/1989 | Puchta et al. | 252/8.6 |
| 4,820,439 | 4/1989 | Rieck | 252/135 |
| 4,832,866 | 5/1989 | Schulz et al. | 252/321 |
| 4,950,310 | 8/1990 | Rieck et al. | 34/295 R |
| 4,959,170 | 9/1990 | Ulrich et al. | 252/135 |
| 5,066,415 | 11/1991 | Dany et al. | 252/135 |
| 5,108,646 | 4/1992 | Beerse et al. | 252/174.25 |

FOREIGN PATENT DOCUMENTS

| | | | |
|---|---|---|---|
| 0253323 | 1/1988 | European Pat. Off. . | |
| 337219A2 | 10/1989 | European Pat. Off. | C11D 3/39 |
| 0445852 | 9/1991 | European Pat. Off. . | |
| 3627773 | 2/1988 | Germany . | |
| 9206151 | 4/1992 | WIPO . | |

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

Particulate compositions are provided incorporating crystalline layered sodium silicates and ionisable material selected from organic acids, organic and inorganic acid salts and mixtures thereof. These particulates can also contain surfactants and other detergent ingredients. Additionally, a method for making these particulates is described as well as a detergent composition incorporating them.

7 Claims, No Drawings

PARTICULATE DETERGENT COMPOSITIONS

This is a continuation of application Ser. No. 08/137,141, filed Oct. 22, 1993, now abandoned, filed as PCT/US92/03286, Apr. 21, 1992.

This invention relates to particulate compositions that incorporate crystalline layered sodium silicates and are suitable for use as, or as a component of, solid detergent compositions, particularly, but not exclusively those designed as fabric cleaning products.

Detergent compositions incorporating crystalline layered sodium silicates are known in the art, being disclosed in, for example, DE-A- 3742043 and EP-A-0337219. These disclosures teach that the layered crystalline forms of sodium silicate display superior mineral hardness sequestration ability relative to the corresponding silicate salts in amorphous form and are thus advantageous as detergent builder materials.

Dishwashing agents consisting of a mixture of a crystalline sodium silicate in combination with a proton donor, wherein a 0.25% aqueous solution of the agent has a pH value of less than 10 are known from EP-A-0416366. The proton donor can be of a wide variety of types including mineral acids, organic acids and their water soluble acid salts. However the objective of EP-A-00416366 is the reduction of the wash liquid pH in order to minimise the irritating effect of the agents on skin and eyes.

The Applicant has found that combinations of specific builder materials that include layered sodium silicates are very efficient in reducing the level of mineral hardness ions during a fabric washing process. This can allow the formulation of products of superior cleaning performance to those now available, or can permit products of equivalent performance to be formulated using less detergent builder and buffer material. The latter finding is of particular value in view of the recent development of so called 'concentrated' granular detergent products of high density and reduced volume.

In order to preserve the physical form, and hence the performance advantages, of crystalline layered silicates, they should not be exposed to media in which they can dissolve prior to dissolution in the wash liquor. This precludes their addition to the aqueous slurry from which spray dried detergent granules are formed and normally requires their addition to the remainder of the detergent components as a substantially dry particulate solid. However, this solid is very frangible and can be difficult to handle in bulk.

Another characteristic of crystalline layered silicates is that they dissolve more slowly in aqueous media than corresponding amorphous silicates. This can result in layered silicate particles adhering to fabrics thus giving rise to localised regions of high pH (>12) under the conditions existing in an automatic fabric washing machine at the beginning of the wash cycle. Such high pH regions can cause damage to certain fabrics such as wool and to certain fabric dyes, particularly where the detergent composition is introduced into the washing machine by a dispensing device placed in the drum of the machine with the fabrics.

The Applicant has now surprisingly found that the above mentioned problems of damage to fabrics and fabric dyes can be mitigated, if not altogether overcome by forming a particulate of the crystalline layered silicate and a solid water-soluble ionisable material of defined characteristics, but without the necessity of reducing the pH of a 1% solution of the particulate to a value less than about 10. In fact, the pH of a 1% wt solution in 20° C. distilled water of preferred particulate compositions in accordance with the invention is approximately 11.8, i.e. only slightly more than half of a pH unit less than the pH of a 1% solution of the crystalline layered silicate material under the same conditions.

These particulates containing crystalline layered silicate and a solid-water ionisable material tend to be hygroscopic in nature. This can lead to problems with compositions containing such particulates in that caking tends to occur on storage in moist conditions. Degradation of builder capacity may also occur on storage in such conditions. The Applicants have however found that the incorporation of binder agent into the particulate can alleviate both of these problems. As well as leading to reduced caking and maintenance of builder capacity the introduction of such binding agents leads also to a reduction in the frangibility of the particulates and aids processing by enhancing the efficiency of pneumatic conveying.

According to one aspect of the present invention, there is provided a particulate composition having a pH as about a 1% by weight solution in 20° C. distilled water of at least about 10, for use as, or as a component of, a solid laundry detergent composition said particulate composition being an intimate mixture of components selected from the group consisting of a) from about 10% to about 95% by weight of a crystalline layered silicate material of formula $NaMSi_xO_{2x+1}.yH_2O$ wherein M is sodium or hydrogen, x is a number from about 1.9 to 4 and y is a number from about 0 to 20;
b) from about 5% to about 90% by weight of a solid water soluble ionisable material selected from organic acids, organic and inorganic acid salts and mixtures thereof said solid water-soluble ionisable material having a mean particle size not greater than about 300 micrometers;
c) from 0% to about 20% by weight of one of more binder agents;
d) from 0% to about 50% by weight of an anionic, nonionic, ampholytic or zwitterionic surfactant; and
e) from 0% to about 50% by weight of detergent ingredients other than those in a) to d) above;

Preferably, the weight ratio of the crystalline silicate material to water-soluble ionisable material is from about 5:1 to about 2:3.

Preferably, the particulate composition is substantially free of unbound (free) moisture, that is it contains no more than 10% by weight, more preferably no more than 5% by weight and most preferably no more than 3% by weight of unbound (free) moisture.

A preferred particulate composition in accordance with the invention includes from about 75 to about 80% by weight of $\delta$-$Na_2Si_2O_5$ of mean particle size no greater than about 300 micrometers and from about 20 to about 25% by weight of citric acid or sodium bicarbonate of mean particle size no greater than about 300 micrometers.

According to another aspect of the invention, a preferred process for making a particulate laundry detergent composition being an intimate admixture of componenets selected from the group consisting of a) from about 10% to about 95% by weight of a crystalline layered silicate material of formula $NaMSi_xO_{2x+1}.yH_2O$ wherein M is sodium or hydrogen, x is a number from about 1.9 to about 4 and y is a number from 0 to about 20;
b) from about 5% to about 90% by weight of a solid water soluble ionisable material selected from organic acids, organic and inorganic acid salts and mixtures thereof, said water-soluble ionisable material having a mean particle size not greater than about 300 micrometers;

c) from 0% to about 20% by weight of a binder agent; comprises the steps of (i) mixing components a), b) and c) together so as to form an intimate substantially uniform mixture;

(ii) compacting the mixture in a roll compactor under a pressure of about 10 to 50, preferably 10 to 30 kN per cm of roll width to form a flaked material; and (iii) comminuting said flaked material to provide a particulate of maximum dimension no greater than about 1200 micrometers.

The invention also encompasses solid, particularly granular, laundry detergent compositions comprising from about 5 to about 30% by weight of organic surfactant, from about 25% to about 60% by weight of detergent builder and from about 10% to about 45% by weight of a particulate composition as hereinbefore described.

The particulate laundry detergent compositions of the invention comprise two essential components, viz. the crystalline layered silicate and the solid water soluble ionisable material. For the purposes of the present invention, a material is defined as water soluble if it dissolves to form a solution of at least 10 g per 100 g of distilled water at 20° C.

The crystalline layered sodium silicate material has the general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2, 3 or 4 and is preferably 2. More preferably M is sodium and y is 0 and preferred examples of this formula comprise the α-, β-, γ- and δ-forms of $Na_2Si_2O_5$. These materials are available from Hoechst AG FRG as respectively NaSKS-5, NaSKS-7, NaSKS-11 and NaSKS-6. The most preferred material is δ-$Na_2Si_2O_5$, NaSKS-6. These materials are processed into free flowing solids with a particle size of from 150 to 1000 micrometers and a bulk density of at least 800 g/liter preferably approximately 900 g/liter. However, as made, the crystals are fragile and break down easily into particles of size less than 100 micrometers.

In the particulate laundry detergent compositions of the present invention, the crystalline layered sodium silicate comprises from about 10% to about 95% by weight of the particulate, more preferably from about 50% to about 90% and most preferably from about 60% to about 80% by weight.

The solid, water-soluble ionisable material is selected from organic acids, organic and inorganic acid salts and mixtures thereof. The primary requirement is that the material should contain at least one functional acidic group of which the pKa should be less than 9, providing a capability for at least partial neutralisation of the hydroxyl ions released by the crystalline layered silicate. Surprisingly, it has been found for the purposes of the present invention, that the ionisable material need not have a pH <7 in solution, or be present in an amount capable of providing hydrogen ions in stoichiometric parity with the hydroxyl ions produced by dissolution of the crystalline silicate. In fact neutralisation of the ionisable material during storage of the particulate, whilst causing a loss in fabric damage benefit, does not eliminate it.

The ionisable material should also have a mean particle size not greater than 300 micrometers and preferably not greater than 100 micrometers. This facilitates uniform distribution of the ionisable material and the crystalline silicate and is believed to enhance localised pH reduction when the particulate dissolves in the wash liquor.

Suitable organic acids include ascorbic, citric, glutaric, gluconic, glycolic, malic, maleic, malonic, oxalic, succinic and tartaric acids, 1 hydroxy ethane 1,1-diphosphonic acid (EHDP), amino poly methylene phosphonic acids such as NTMP, EDTMP & DETPMP, and mixtures of any of the foregoing. Suitable acid salts include sodium hydrogen carbonate, sodium hydrogen oxalate, sodium hydrogen sulphate, sodium acid pyrophosphate, sodium acid orthophosphate, sodium hydrogen tartrate or mixtures of any of the foregoing.

For the purposes of the present invention it is important that the solid water soluble ionisable acid material is in intimate admixture with the crystalline layered sodium silicate. Coating of the silicate by the ionisable material or mere admixture of the two components has not between found to be adequate to provide the benefits of the present invention. Thorough mixing of the two components to provide thorough distribution of one with the other has been found to be necessary and preferred techniques for so doing are described hereinafter. The resulting particulate mixture of crystalline layered silicate and solid water soluble ionisable material will have a pH of at least about 10 (as measured on a 1% solution in 20° C. distilled water) and more usually will have a pH of at least about 11, normally at least about 11.5.

The particulate compositions of the present invention also comprise from 0% to about 20% by weight of one or more binder agents. Such binder agents assist in binding the silicate and ionisable water soluble material so as to produce particulates of the desired physical characteristics. Preferably, the binder agents will be in intimate admixture with the silicate and ionisable water soluble material. Preferred binder agents have a melting point between 30° C.–70° C. The binder agents are preferably present in amounts from about 1–20% by weight of the composition more preferably from about 1–10% by weight of the composition and most preferably from about 2–5% by weight of the composition.

Preferred binder agents in accordance with the invention include the $C_{10}$–$C_{20}$ alcohol ethoxylates containing from about 5–100 moles of ethylene oxide per mole of alcohol and more preferably the $C_{15}$–$C_{20}$ primary alcohol ethoxylates containing from about 20–100 moles of ethylene oxide per mole of alcohol.

Other preferred binder agents in accordance with the invention include certain polymeric materials. Polyvinylpyrrolidones with an average molecular weight of from about 12,000 to 700,000 and polyethylene glycols with an average weight of from about 600 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from about 5–100 moles of ethylene oxide per mole. Further examples of binder agents in accordance with the invention include the $C_{10}$–$C_{20}$ mono- and diglycerol ethers and also the $C_{10}$–$C_{20}$ fatty acids. Solutions of certain inorganic salts including sodium silicate are also of use for this purpose.

Cellulose derivatives such as methylcellulose, carboxymethylcellulose and hydroxyethylcellulose, and homo- or co-polymeric polycarboxylic acid or their salts are other examples of binder agents in accordance with the invention.

The particulate can also include other components that are conventional in detergent compositions, provided that these are not incompatible per se and do not interfere with the building function of the crystalline layered silicate. Thus the particulate can include up to 50% by weight of the particulate of an anionic, nonionic, ampholytic or zwitterionic surfactant or a mixture of any of these and certain preferred particulate embodiments incorporate surfactants. Examples of such surfactants are described more fully hereinafter. However it is important that any surfactant material that is incorporated into the particulate does not introduce a level of free (unbound) moisture that can even partially dissolve the crystalline layered silicate. For this purpose, the surfactant should be solid and should preferably contain no more than about 5% free (unbound) moisture, preferably no more than 2% free moisture and most preferably less than 1% free moisture.

Other detergent ingredients can also be incorporated in a total amount of up to 50% by weight of the particulate, subject to the same conditions set out above for the inclusion of surfactants. Thus such optional ingredients should preferably be solid at normal (ambient) temperatures, and should contain no more than about 5% by weight of free (unbound) moisture, preferably less than 1%.

Non-aqueous liquid components can be incorporated in amounts of up to 20% by weight of the particulate provided that the crystalline layered silicate does not have an appreciable solubility in such components. This also applies to normally solid components applied in a molten form to serve as agglomeration/coating agents for the particulate.

The particulate compositions of the present invention can take a variety of physical forms such as extrudates, marumes, agglomerates, flakes or compacted granules. All of these forms share several characteristics of the compositions of the invention, viz. that they have a pH of at least about 10, as a 1% solution in distilled water at 20° C., that they comprise an intimate mixture of the crystalline layered silicate and the ionisable material, and that they are substantially free of unbound moisture.

It has been found possible to prepare compacted granules incorporating preferred compositions of the present invention without the necessity for additional components. According to a process aspect of the invention, preferred compositions in accordance with the invention are mixed, subjected to a dry compaction step to form a flake and then comminuted to provide a finished particulate of particle size no greater than 1200 micrometers.

In the first, mixing, step, the crystalline layered silicate, preferably $\delta$-$Na_2Si_2O_5$ (NaSKS-6) is added, together with anhydrous powdered citric acid or sodium bicarbonate in a weight ratio ranging from 80:20 to 75:25, to a powder mixer such as a cube mixer or Nautamixer. The layered silicate is in fine powder form, i.e. has a particle size in which 90% is less than 100 micrometers and the citric acid or sodium bicarbonate is also a fine powder (mean particle size approx. 50 micrometers). The intimate mixture of the powders is then fed to a compacting roll (Model L200/50P manufactured by Bepex GmbH, Postfach 1142, Daimlerstrasse 8, Leingarten, Heilbron, FDR) and subjected to a nip pressure of from 10 to 50, preferably 10 to 30 kN/cm roll width, more preferably approximately 25 kN/cm roll width.

The resultant flake product is treated in a prebreaker before being comminuted in a hammer mill (Condux swing hammer mill Type LHM20/16 manufactured by Condux-Werk GmbH, D6450 Wolfgang bei Hanau, FDR) to give a compacted granule having a particle size in the range from 150 to 1140 micrometers with a weight mean particle size of approximately 600 micrometers. Particles of size less than 150 micrometers are recycled to the compaction stage, while particles of size more than 1140 micrometers are subjected to comminution in a second hammer mill set up to provide material within the desired particle size range. Particulate compositions made in accordance with the above described process are exemplified hereinafter and possess satisfactory physical robustness whilst providing the desired protection against damage to fabrics and dyes. Particles made in accordance with the above described process are also substantially free of unbound water as the starting materials are effectively anhydrous and no water is added during processing.

Nevertheless, the incorporation of other ingredients additional to the crystalline layered silicate and ionisable water soluble compound can be advantageous particularly in the processing of the particulate and also in enhancing the stability of detergent compositions in which the particulates are included. In particular, certain types of agglomerates may require the addition of one or more binder agents in order to assist in binding the silicate and ionisable water soluble material so as to produce particulates with acceptable physical characteristics. The binder agents in accord with the invention may be present at a level of from 0% to about 20% by weight of the composition. Preferred examples of binder agents together with preferred levels of incorporation have been hereinbefore described.

The preparation of extrudates and marumes involves the mixing of component materials in a closed vessel and the forcing of the mixture through orifices under pressure in order to produce the particulates and an auxiliary component additional to the crystalline layered silicate and ionisable material and having wax-like properties will normally be necessary in order to facilitate handling in the extrusion or marumerising equipment. This component will usually be added at a level of from about 0.5% to about 10% by weight of the particulate, more preferably at a level of from about 1.0% to about 5.0% by weight.

Ethoxylated nonionic surfactants such as $C_{14}$–$C_{18}$ alcohol ethoxylates and polymeric organic materials such as polyethylene glycols and maleic anhydride acrylic acid copolymers represent suitable auxiliary components for this purpose.

According to a further aspect of the invention, a detergent composition is provided incorporating the crystalline layered silicate particulate composition as one of the components. Detergent compositions formulated for fabric cleaning purposes conventionally incorporate organic surfactants, detergent builders, oxygen bleach systems and ancillary materials such as anti-redeposition and soil suspension agents, suds suppressors, heavy metal ion chelating agents, enzymes, optical brighteners, photoactivated bleaches, perfumes and colours. Some products also include fabric softening and antistatic agents Such detergent compositions conventionally have a pH as measured on a 1% by weight solution in 20° C. distilled water of at least about 9.5, preferably from about 10.0 to 10.5.

A wide range of surfactants can be used in the detergent compositions. A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981.

Mixtures of anionic surfactants are suitable herein, particularly blends of sulphate, sulphonate and/or carboxylate surfactants. Mixtures of sulphonate and sulphate surfactants are normally employed in a sulphonate to sulphate weight ratio of from about 5:1 to 1:2, preferably from about 5:1 to 2:3 more preferably from about 3:1 to 2:3, most preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source, preferably from a $C_{16}$–$C_{18}$ fatty source. In each instance the cation is an alkali metal, preferably sodium. Preferred sulphate surfactants in such sulphonate sulphate mixtures are alkyl sulphates having from 12 to 22, preferably 16 to 18 carbon atoms in the alkyl radical. Another useful surfactant system comprises a mixture of two alkyl sulphate materials whose respective mean chain lengths differ from each other. One such system comprises a mixture of $C_{14}$–$C_{15}$ alkyl sulphate and $C_{16}$–$C_{18}$ alkyl sulphate in a weight ratio of $C_{14}$–$C_{15}$:$C_{16}$–$C_{18}$ of from 3:1 to 1:1. The alkyl sulphates may also be combined with alkyl ethoxy sulphates having from 10 to 20, preferably 10 to 16 carbon atoms in the alkyl radical and an average degree of ethoxylation of 1 to 6. The cation in each instance is again an alkali metal, preferably sodium.

Other anionic surfactants suitable for the purposes of the invention are the alkali metal sarcosinates of formula $$R—CON(R^1)CH_2COOM$$

wherein R is a $C_9$–$C_{17}$ linear or branched alkyl or alkenyl group, R' is a $C_1$–$C_4$ alkyl group and M is an alkali metal ion. Preferred examples are the lauroyl, Coeoyl ($C_{12}$–$C_{14}$), myristyl and oleyl methyl sarcosinates in the form of their sodium salts.

One class of nonionic surfactants useful in the present invention comprises condensates of ethylene oxide with a hydrophobic moiety, providing surfactants having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.1 to 4, the compounds including less than 10% unreacted fatty alcohol and less than 50% short chain alkyl polyglucosides.. Compounds of this type and their use in detergent compositions are disclosed in EP-B 0070074, 0070077, 0075996 and 0094118.

Another preferred nonionic surfactant is a polyhydroxy fatty acid amide surfactant compound having the structural formula:

$$R^{2'}—\overset{\overset{\displaystyle O}{\|}}{C}—\overset{\overset{\displaystyle R^1}{|}}{N}—Z$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof: and Z is a polyhydroxyhydrocarbyl having a linear hydrocarbyl chain with at least 3 hydroxyls directly connected to the chain, or an alkoxlylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc. Preferred compound are N-methyl N-1deoxyglucityl $C_{14}$–$C_{18}$ fatty acid amides.

A further class of surfactants are the semi-polar surfactants such as amine oxides. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

The detergent compositions comprise from about 5% to about 30% of surfactant but more usually comprise from about 7% to about 20%, more preferably from about 10% to about 15% surfactant by weight of the compositions.

Combinations of surfactant types are preferred, more especially anionic-nonionic and also anionic-nonionic-cationic blends. Particularly preferred combinations are described in GB-A-2040987 and EP-A- 0087914. Although the surfactants can be incorporated into the compositions as mixtures, it is preferable to control the point of addition of each surfactant in order to optimise the physical characteristics of the composition and avoid processing problems.

Preferred modes and orders of surfactant addition are described hereinafter.

Another highly preferred component of detergent compositions incorporating the crystalline layered silicate particulates of the invention is a detergent builder system comprising one or more other non-phosphate detergent builders. These can include, but are not restricted to, alkali metal aluminosilicates, monomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates), carbonates, silicates and mixtures of any of the foregoing. The builder system is present in an amount of from about 25% to about 60% by weight of the system, more preferably from about 30% to about 60% by weight.

Whilst a range of aluminosilicate ion exchange materials can be used, preferred sodium aluminosilicate zeolites have the unit cell formula $$Na_z[(AlO_2)_z(SiO_2)_y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [6 grains/gallon/minute/(gram/gallon)], based on calcium ion hardness. Optimum aluminosilicates for builder purposes exhibit a calcium ion exchange rate of at least 260 mg equivalent of $CaCO_3$/liter/minute/(gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite P, Zeolite X, Zeolite HS and mixtures thereof. In an especially preferred embodiment, the crystalline aluminosilicate ion exchange material is Zeolite A and has the formula $$Na_{12}[(AlO_2)_{12}(SiO_2)_{12}].xH_2O$$

wherein x is from 20 to 30, especially 27. Zeolite X of formula $Na_{86}$ $[(AlO_2)_{86}(SiO_2)_{106}]$. 276 $H_2O$ is also suitable, as well as Zeolite HS of formula $Na_6[(AlO_2)_6(SiO_2)_6]$ 7.5 $H_2O$).

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The logarithmic acidity constant is defined by reference to the equilibrium $$H^+ + A^- \leftrightharpoons HA$$

where A is the fully ionized carboxylate anion of the builder salt.

The equilibrium constant is therefore $$K_1 = \frac{[HA]}{[H^+][A^-]}$$

and $pK_1 = \log_{10}K$.

For the purposes of this specification, acidity constants are defined at 25 ° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

Preferred carboxylates can also be defined in terms of their calcium ion stability constant ($pK_{Ca^{++}}$) defined, analogously to $pK_1$, by the equations $$pK_{Ca^{++}} = \log 10\ K_{Ca^{++}}$$

$$\text{where } K_{Ca^{++}} = \frac{(Ca^{++}\ A)}{(Ca^{++})(A)}$$

Preferably, the polycarboxylate has a $pK_{Ca^{++}}$ in the range from about 2 to about 7, especially from about 3 to about 6. Once again literature values of stability constant are taken where possible. The stability constant is defined at 25° C. and at zero ionic strength using a glass electrode method of measurement as described in Complexation in Analytical Chemistry by Andera Ringborn (1963).

The carboxylate or polycarboxylate builder can be momomeric or oligomeric in type although monomeric polycarboxylates are generally preferred for reasons of cost and performance.

Monomeric and oligomeric builders can be selected from acyclic, allcyclic, heterocyclic and aromatic carboxylates having the general formulae

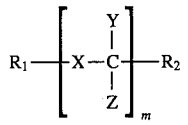

(a)

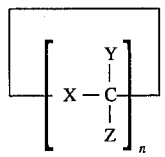

(b)

or

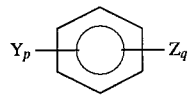

(c)

wherein $R_1$ represents H, $C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H, $C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy;hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6; and wherein, X, Y, and Z each have the same or different representations when repeated in a given molecular formula, and wherein at least one Y or Z in a molecule contain a carboxyl group.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa- 1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofurantetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. These materials are normally used at levels of from about 0.5% to about 10% by weight more preferably from about 0.75% to about 8%, most preferably from about 1% to about 6% by weight of the composition.

Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired.

Whilst soluble silicates serve a variety of purposes in conventional formulations, their presence is unnecessary in compositions in accordance with the present invention. However as the crystalline layered silicate, which forms part of the builder system of the detergent composition, must be added as a dry mix ingredient, soluble silicates may still be useful as structurants in the spray dried granules that normally form part of a detergent composition. This is particularly desirable if the spray dried granule does not incorporate an aluminosilicate builder and would otherwise comprise only organic materials. Suitable silicates are those having an $SiO_2$:$Na_2O$ ratio in the range from 1.6 to 3.4, ratios from 2.0 to 2.8 being preferred.

For the purposes of detergent compositions incorporating the crystalline layered silicate particulates of the invention as part of the builder system, the non-phosphate builders will comprise from about 25% to about 60% by weight of the compositions, more preferably from about 30% to about 60% by weight. Within the preferred detergent compositions, sodium aluminosilicate such as Zeolite A will comprise from about 20% to about 60% by weight of the total amount of builder, a monomeric or oligomeric carboxylate will comprise from about 5% to about 30% by weight of the total amount of builder and the crystalline layered silicate will comprise from about 10% to about 65% by weight of the total amount of builder. In such compositions the builder system preferably also incorporates a combination of auxiliary inorganic and organic builders such as sodium carbonate and maleic anhydride/acrylic acid copolymers in amounts of up to about 35% by weight of the total builder.

Detergent compositions incorporating the crystalline layered silicate particulate compositions of the present invention will generally include an inorganic perhydrate bleach, normally in the form of the sodium salt. The perhydrate is usually incorporated at a level of from about 3% to about 22% by weight, more preferably from 5% to 20% by weight and most preferably from 8% to 18% by weight of the composition.

The perhydrate may be any of the inorganic salts such as perborate, percarbonate, perphosphate and persilicate salts but is conventionally an alkali metal normally sodium, perborate or percarbonate. Sodium perborate can be in the form of the monohydrate of nominal formula $NaBO_2H_2O_2$ or the tetrahydrate $NaBO_2H_2O_2.3H_2O$.

Sodium percarbonate, which is the preferred perhydrate, is an addition compound having a formula corresponding to $2Na_2CO_3.3H_2O_2$, and is available commercially as a crystalline solid. Most commercially available material includes a low level of a heavy metal sequestrant such as EDTA, 1-hydroxyethylidene 1, 1-diphosphonic acid (HEDP) or an amino-phosphonate, that is incorporated during the manufacturing process. Although the percarbonate can be incorporated into detergent compositions without additional protection, preferred executions of such compositions utilise a coated form of the material. A variety of coatings can be used, but the most economical is sodium silicate of $SiO_2$:$Na_2O$ ration from 1.6:1 to 3.4:1, preferably 2.8:1, applied as an aqueous solution to give a level of from about 2% to about 10%, (normally from 3% to 5% ) of silicate solids by weight of the percarbonate. Magnesium silicate can also be included in the coating. Other suitable coating materials include the alkali and alkaline earth metal sulphates and carbonates.

Whilst heavy metals present in the sodium carbonate used to manufacture the percarbonate can be controlled by the inclusion of sequestrants in the reaction mixture, the percarbonate still requires protection from heavy metals present as impurities in other ingredients of the product. Accordingly, in detergent compositions utilising percarbonate as the perhydrate salt, the total level of Iron, Copper and Manganese ions in the product should not exceed 25 ppm and preferably should be less than 20 ppm in order to avoid an unacceptably adverse effect on percarbonate stability. Detergent compositions in which alkali metal percarbonate bleach has enhanced stability are disclosed in the Applicant's copending British Patent Application No. 9021761.3

Bleach systems incorporated into detergent compositions of the present invention preferably include solid peroxyacid bleach precursors (bleach activators).

These precursors probably contain one or more N- or O-acyl groups, which precursors can be selected from a wide range of classes. Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864,798, 1147871 and 2143231 and imides such as are disclosed in GB-A-855735 & 1246338.

Particularly preferred precursor compounds are the N,N, $N^1N^1$ tetra acetylated compounds of formula

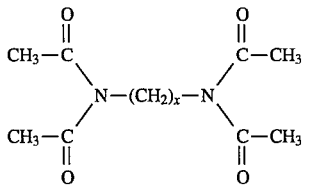

wherein x can be O or an integer between 1 & 6.

Examples include tetra acetyl methylene diamine (TAMD) in which x= 1, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Detergent compositions in which the solid peroxybleach precursors are protected via an acid coating to minimise fabric colour damage are disclosed in the Applicant's copending British Application No. 9102507.2 filed Feb. 6 1991.

Anti-redeposition and soil-suspension agents suitable herein include cellulose derivatives such as methylcellulose, carboxymethylcellulose and hydroxyethycellulose, and homo-or co-polymeric polycarboxylic acids or their salts. Polymers of this type include copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from about 0.20% to 5% more preferably from about 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Preferred optical brighteners are anionic in character, examples of which are disodium $4,4^1$-bis-(2-diethanolamino-4-anilino-s-triazin-6-ylamino)stilbene- $2:2^1$ disulphonate, disodium $4,4^1$-bis-(2-morpholino- 4-anilino-2-triazin-6-ylaminostilbene-$2:2^1$-disulphonate,disodium 4, $4^1$-bis-( 2,4-dianilino-s-triazin-6-ylamino)stilbene-$2:2^1$-disulphonate, monosodium $4^1,4^{11}$-bis-(2,4-dianilino-s-triazin-6-ylamino)stilbene-2-sulphonate, disodium $4,4^1$-bis-(2-anilino-4-(N-methyl-N-2-hydroxyethylamino)- 2-triazin-6-ylamino)stilbene-$2,2^1$-disulphonate, disodium $4,4^1$-bis-(4-phenyl-2,1,3-triazol-2-yl)stilbene-$2,2^1$ disulphonate, disodium $4,4^1$bis(2-anilino-4-(1-methyl-2-hydroxyethylamino)-s-triazin- 6-ylamino)stilbene-$2,2^1$disulphonate and sodium $2(\text{stilbyl-}14^{11}\text{-(naphtho-}1^1,2^1\text{:}4,5)\text{-}1,2,3\text{-triazole-}2^{11}$-sulphonate.

Soil-release agents useful in compositions of the present invention are conventionally copolymers or terpolymers of terephthalic acid with ethylene glycol and/or propylene glycol units in various arrangements.

Examples of such polymers are disclosed in the commonly assigned U.S. Pat. Nos. 4,116,885 and 4,711,730 and European Published Patent Application No. 0272033. A particular preferred polymer in accordance with EP-A-0272033 has the formula $$(CH_3(PEG)_{43})_{0.75}(POH)_{0.25}[T\text{-}PO)_{2.8}(T\text{-}PEG)_{0.4}]T(PO\text{-}H)_{0.25}((PEG)_{43}\ CH_3)_{0.75}$$ where PEG is $—(OC_2H_4)O$-,PO is $(OC_3H_6O)$ and T is $(pCOC_6H_4CO)$.

Certain polymeric materials such as polyvinyl pyrrolidones, typically of MWt 5000–20000, preferably 10000–15000, also form useful agents in preventing the transfer of labile dyestuffs between fabrics during the washing process.

Another optional detergent composition ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et el. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

The suds suppressors described above are normally employed at levels of from 0.001% to 0.5% by weight of the composition, preferably from 0.01% to 0.1% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Fabric softening agents can also be incorporated into detergent compositions in accordance with the present invention. These agents may be inorganic or organic in type. Inorganic softening agents are examplified by the smectite clays disclosed in GB-A-1,400,898. Organic fabric softening agents include the water insoluble tertiary amines as disclosed in GB-A-1514276 and EP-B-0011340.

Their combination with mono $C_{12}$–$C_{14}$ quaternary ammonium salts is disclosed in EP-B-0026527 & 528. Other useful organic fabric softening agents are the dilong chain amides as disclosed in EP-B- 0242919. Additional organic ingredients of fabric softening systems include high molecular weight polyethylene oxide materials as disclosed in EP-A-0299575 and 0313146.

Levels of smectite clay are normally in the range from about 5% to about 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

In general detergent compositions in accordance with the present invention can be made via a variety of methods including dry mixing, spray drying, agglomeration and granulation and preferred methods involve combinations of these techniques. A preferred method of making the compositions involves a combination of spray drying, agglomeration in a high speed mixer and dry mixing.

The crystalline layered silicate particulate compositions of the present invention are particularly useful in concentrated granular detergent compositions that are characterised by a relatively high density in comparison with conventional laundry detergent compositions. Such high density compositions have a bulk density of at least 650 g/liter, more usually at least 700 g/liter and more preferably in excess of 800 g/liter.

Bulk density, is measured by means of a simple funnel and cup device consisting of a conical funnel moulded rigidly on a base and provided with a flap valve at its lower extremity to allow the contents of the funnel to be emptied into an axially aligned cylindricl cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

Concentrated detergent compositions also normally incorporate at least one multi-ingredient component i.e. they do not comprise compositions formed merely by dry-mixing individual ingredients. Compositions in which each individual ingredient is dry-mixed are generally dusty, slow to dissolve and also tend to cake and develop poor particle flow characteristics in storage.

Preferred detergent compositions in accordance with the invention comprise at lease two particulate multi-ingredient components. The first component comprises at least about 15%, conventionally from about 25% to about 50%, but more preferably no more than about 35% by weight of the composition and the second component from about 1% to about 50%, more preferably about 10% to about 443% by weight of the composition.

The first component comprises a particulate incorporating an anionic surfactant in an amount of from 0.75% to ,40% by weight of the powder and one or more inorganic and/or organic salts in an amount of from 99.25% to 60% by weight of the powder. The particulate can have any suitable form such as granules, flakes, prills, marumes or noodles but is preferably granular. The granules themselves may be agglomerates formed by pan or drum agglomeration or by in-line mixers but are customarily spray dried particles produced by atomising an aqueous slurry of the ingredients in a hot air stream which removes most of the water. The spray dried granules are then subjected to densification steps, e.g. by high speed cutter mixers and/or compacting mills, to increase density before being reagglomerated. For illustrative purposes, the first component is described hereinafter as a spray dried powder.

Suitable anionic surfactants for the purposes of the first component have been found to be slowly dissolving linear alkyl sulfate salts in which the alkyl group has an average of from 16 to 22 carbon atoms, and linear alkyl carboxylate salts in which the alkyl group has an average of from 16 to 24 carbon atoms. The alkyl groups for both types of surfactant are preferably derived from natural sources such as tallow fat and marine oils.

The level of anionic surfactant in the spray dried powder forming the first component is from 0.75% to 443% by weight, more usually 2.5% to 25% preferably from 3% to 20% and most preferably from 5% to 15% by weight. Water-soluble surfactants such as linear alkyl benzene sulphonates or $C_{14}$–$C_{15}$ alkyl sulphates can be included or alternatively may be applied subsequently to the spray dried powder by spray on.

The other major ingredient of the spray dried powder is one or more inorganic or organic salts that provide the crystalline structure for the granules. The inorganic and/or organic salts may be water-soluble or water-insoluble, the latter type being comprised by the, or the major part of the, water-insoluble builders where these form part of the builder ingredient. Suitable water soluble inorganic salts include the alkali metal carbonates and bicarbonates. Amorphous alkali metal silicates may also be used to provide structure to the spray dried granule provided that aluminosilicate does not form part of the spray dried component.

However, in concentrated detergent compositions it is preferred that no sodium sulphate is added as a separate ingredient and its incorporation as a by-product e.g. with sulph(on)ated surfactants, should be minimised.

Where an aluminosilicate zeolite forms the, or part of the, builder ingredient, it is preferred that it is not added directly by dry-mixing to the other components, but is incorporated into the multi-ingredient component(s).

The first component can also include up to 15% by weight of miscellaneous ingredients such as brighteners, anti-redeposition agents, photoactivated bleaches (such as tetrasulfonated zinc phthalocyanine) and heavy metal sequestering agents. Where the first component is a spray dried powder it will normally be dried to a moisture content of from 7% to 11% by weight, more preferably from 8% to 10% by weight of the spray dried powder. Moisture contents of powders produced by other processes such as agglomeration may be lower and can be in the range 1–10% by weight.

The particle size of the first component is conventional and preferably not more than 5% by weight should be above 1.4 mm, while not more than 10% by weight should be less than 0.15 mm in maximum dimension. Preferably at least 60%, and most preferably at least 80%, by weight of the powder lies between 0.7 mm and 0.25 mm in size. For spray dried powders, the bulk density of the particles from the spray drying tower is conventionally in the range from 540 to 600 g/liter and this is then enhanced by further processing steps such as size reduction in a high speed cutter/mixer followed by compaction. Alternatively, processes other than spray drying may be used to form a high density particulate directly.

A second component of a preferred composition in accordance with the invention is another multi-ingredient particulate containing a water soluble surfactant.

This may be anionic, nonionic, cationic or semipolar in type or a mixture of any of these. Suitable surfactants are listed hereinbefore but preferred surfactants are $C_{14}$–$C_{15}$ alkyl sulphates, linear $C_{11}$–$C_{15}$ alkyl benzene sulphonates and fatty $C_{14}$–$C_{18}$ methyl ester sulphonates.

The second component may have any suitable physical form, i.e. it may take the form of flakes, prills, marumes, noodles, ribbons, or granules which may be spray-dried or non spray-dried agglomerates. Although the second component could in theory comprise the water soluble surfactant on its own, in practice at least one organic or inorganic salt is included to facilitate processing. This provides a degree of crystallinity, and hence acceptable flow characteristics, to the particulate and may be any one or more of the organic or inorganic salts present in the first component.

The particle size range of the second component should be such as to obviate segregation from the particles of the first component when blended therewith. Thus not more than 5% by weight should be above 1.4 mm while not more than 10% should be less than 0.15 mm in maximum dimension.

The bulk density of the second component will be a function of its mode of preparation. However, the preferred form of the second component is a mechanically mixed agglomerate which may be made by adding the ingredients dry or with an agglomerating agent to a pan agglomerator, Z blade mixer or more preferably an in-line mixer such as those manufactured by Schugi (Holland) BV, 29 Chroomstraat 8211 AS, Lelystad, Netherlands and Gebruder Lodige MaschinenbanGmbH, D-4790 Paderborn 1, Elsenerstrasse 7-9, Postfach 2050 F.R.G. By this means the second component can be given a bulk density in the range from 650 g/liter to 1190 g/liter more preferably from 750 g/liter to 850 g/liter.

Preferred compositions include a level of alkali metal carbonate in the second component corresponding to an amount of from about 3% to about 15% by weight of the composition, more preferably from about 5% to about 12% by weight. This will provide a level of carbonate in the second component of from about 20% to about 40% by weight.

A highly preferred ingredient of the second component is also a hydrated water insoluble aluminosilicate ion exchange material of the synthetic zeolite type, described hereinbefore, present at from about 10% to about 35% by weight of the second component. The amount of water insoluble aluminosilicate material incorporated in this way is from 1% to 10% by weight of the composition, more preferably from 2% to 8% by weight.

In one process for preparing the second component, the surfactant salt is formed in situ in an inline mixer. The liquid acid form of the surfactant is added to a mixture of particulate anhydrous sodium carbonate and hydrated sodium aluminosilicate in a continuous high speed blender, such as a Lodige KM mixer, and neutralised to form the surfactant salt whilst maintaining the particulate nature of the mixture. The resultant agglomerated mixture forms the second component which is then added to other components of the product. In a variant of this process, the surfactant salt is pre-neutralised and added as a viscous paste to the mixture of the other ingredients. In the variant, the mixer serves merely to agglomerate the ingredients to form the second component.

In a particularly preferred process for making detergent compositions incorporating the crystalline layered silicate particulate compositions of the invention, part of the spray dried product comprising the first granular component is diverted and subjected to a low level of nonionic surfactant spray on before being reblended with the remainder. The second granular component is made using the preferred process described above. The first and second components together with the crystalline layered silicate particulate compositions, the perhydrate bleach and any peroxy acid bleach precursor particles, other dry mix ingredients such as any carboxylate chelating agent, soil-release polymer and enzyme are then fed to a conveyor belt, from which they are transferred to a horizontally rotating drum in which perfume and silicone suds suppressor are sprayed on to the product. In highly preferred compositions, a further dram mixing step is employed in which a low (approx. 2% by weight) level of finely divided crystalline material is introduced to increase density and improve granular flow characteristics.

In preferred concentrated detergent products incorporating an alkali metal percarbonate as the perhydrate salt it has been found necessary to control several aspects of the product such as its heavy metal ion content and its equilibrium relative humidity. Sodium percarbonate-containing compositions of this type having enhanced stability are disclosed in the commonly assigned British Application No. 9021761.3 filed Oct. 6, 1990 (Attorney's Docket No. CM343).

Compositions in accordance with the invention can also benefit from delivery systems that provide transient localised high concentrations of product in the drum of an automatic washing machine at the start of the wash cycle, thereby also avoiding problems associated with loss of product in the pipework or sump of the machine.

Delivery to the drum can most easily be achieved by incorporation of the composition in a bag or container from which it is rapidly releasable at the start of the wash cycle in response to agitation, a rise in temperature or immersion in the wash water in the drum. Alternatively the washing machine itself may be adapted to permit direct addition of the composition to the drum e.g. by a dispensing arrangement in the access door.

Products comprising a detergent composition enclosed in a bag or container are usually designed in such a way that container integrity is maintained in the dry state to prevent egress of the contents when dry, but are adapted for release of the container contents on exposure to a washing environment, normally on immersion in an aqueous solution.

Usually the container will be flexible, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such,as polyethylene or polypropylene. In a variant of the bag or container form, laminated sheet products can be employed in which a central flexible layer is impregnated and/or coated with a composition and then one or more outer layers are applied to produce a fabric-like aesthetic effect. The layers may be sealed together so as to remain attached during use, or may separate on contact with water to facilitate the release of the coated or impregnated material.

An alternative laminate form comprises one layer embossed or deformed to provide a series of pouch-like containers into each of which the detergent components are deposited in measured amounts, with a second layer overlying the first layer and sealed thereto in those areas between the pouch-like containers where the two layers are in contact. The components may be deposited in particulate, paste or molten form and the laminate layers should prevent egress of the contents of the pouch-like containers prior to their addition to water. The layers may separate or may remain attached together on contact with water, the only requirement being that the structure should permit rapid release of the contents of the pouch-like containers into solution. The number of pouch-like containers per unit area of substrate is a matter of choice but will normally vary between 500 and 25,000 per square meter.

Suitable materials which can be used for the flexible laminate layers in this aspect of the invention include, among others, sponges, paper and woven and non-woven fabrics.

However the preferred means of carrying out the process of the invention is to introduce the composition into the liquid surrounding the fabrics that are in the drum via a reusable dispensing device having walls that are permeable to liquid but impermeable to the solid composition.

Devices of this kind are disclosed in European Patent Application Publication Nos. 0343069 & 0343070. The latter Application discloses a device comprising a flexible sheath in the form of a bag extending from a support ring defining an orifice, the orifice being adapted to admit to the bag sufficent product for one washing cycle. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

The invention is illustrated in the following non limiting Examples, in which all percentages are on a weight basis unless otherwise stated.

In the detergent compositions, the abbreviated component identifications have the following meanings:

| | |
|---|---|
| $C_{12}$LAS | Sodium linear $C_{12}$ alkyl benzene sulphonate |
| TAS | Sodium tallow alkyl sulphate |
| $C_{14/15}$AS | Sodium $C_{14}$–$C_{15}$ alkyl sulphate |
| $TAE_n$ | Tallow alcohol ethoxylated with n moles of ethylene oxide per mole of alcohol |
| 45EY | A $C_{14-15}$ predominantly linear primary alcohol condensed with an average of Y moles of ethylene oxide |
| $CnAE_{E6.5}$ | A $C_{12}$–$C_{13}$ primary alcohol condensed with 6.5 moles of ethylene oxide. |
| PEG | Polyethylene glycol (MWt normally follows) |
| TAED | Tetraacetyl ethylene diamine |
| Silicate | Amorphous Sodium Silicate ($SiO_2$:$Na_2O$ ratio normally follows) |
| NaSKS-6 | Crystalline layered silicate of formula $Na_2Si_2O_5$ |
| Carbonate | Anhydrous sodium carbonate |
| Bicarbonate | Anhydrous sodium hydrogen carbonate |
| CMC | Sodium carboxymethyl cellulose |
| Zeolite A | Hydrated Sodium Aluminosilicate of formula $NA_{12}(AlO_2SiO_2)_{12}.27H_2O$ having a primary particle size in the range from 1 to 10 micrometers |
| Polyacrylate | Homopolymer of acrylic acid of MWt 4000 |
| Citrate | Trisodium citrate dehydrate |
| Photo-activated Bleach | Tetra sulphonated Zinc phthalocyanine |
| MA/AA | Copolymer of 1:4 maleic/acrylic acid, average molecular weight about 80,000. |
| MVEMA | Maleic anhydride/vinyl methyl ether copolymer, believed to have an average molecular weight of 240,000. This material was prehydrolysed with NaOH before addition. |
| Perborate | Sodium perborate tetrahydrate of nominal formula $NaBO_2.3H_2O.H_2O_2$ |
| Perborate Monohydrate | Anhydrous sodium perborate bleach empirical formula $NaBO_2.H_2O_2$ |
| Percarbonate | Sodium Percarbonate of nominal formula $2Na_2CO_3.3H_2O_2$ |
| Enzyme | Mixed proteolytic and amylolytic enzyme sold by Novo Industries AS. |
| Brightener | Disodium 4,4'-bis(2-morpholino-4-anilino-s-triazin-6-ylamino) stilbene-2:2'-disulphonate. |
| DETPMP | Diethylene triamine penta (methylene phosphonic acid), marketed by Monsanto under the Trade name Dequest 2060 |
| Mixed Suds Suppressor | 25% paraffin wax Mpt 50° C., 17% hydrophobic silica, 58% paraffin oil. |

EXAMPLE 1 a) 1.1 kg of crystalline layered silicate —$Na_2Si_2O_5$ (SKS-6 supplied by Hoechst AG.) of particle size <300 micrometers and 0.3 kg of anhydrous citric acid of particle size <300 micrometers were premixed in an Eirich RVO2 mixer with a rotor speed of 500 rpm for 2 minutes so that an intimate mixture of the two powders was formed. The resulting mixture was fed into the feed hopper of a Bepex roll compactor (Model L200/50P). The feed hopper was fitted with an agitator, which rotated at 50 rpm, and the mixture was continually added to the hopper to keep the fill level constant and ensure a uniform feed to the compactor. The roll compactor was then started and the powder mixture was fed to the roll nip to give a nip pressure of 25 kN/cm of roll width. The resultant flake was then subjected to a single pass through a Condux hammer mill Type LHM 20/16 and subsequently sieved to provide 0.7 kg of particles having a mean particle size of 600 micrometers with 95% by weight being greater than 200 micrometers and 95% by weight being less than 1200 micrometers.

b) 1.1 kg of crystalline layered silicate and 0.3 kg of anhydrous citric acid as used in a) above were premixed using the same procedure. The mixture was then subjected to a spray on of 0.05 kg of molten TAE50 before being fed to the feed hopper of the compactor. The resultant flake was passed through the Condux Hammer mill to provide particles having a mean size of 600 micrometers, with 95% by weight being greater than 200 micrometers and 95% by weight being less than 1200 micrometers. Similar results were obtained if 45E7 was substituted for the TAE50 nonionic surfactant.

EXAMPLE 2

The following compositions were prepared (Parts by weight).

| | A | B | C | D |
|---|---|---|---|---|
| $C_{12}$LAS | 6.27 | 6.27 | 6.27 | 6.27 |
| TAS | 4.15 | 4.15 | 4.15 | 4.15 |
| 45E7 | 3.85 | 3.85 | 3.85 | 3.85 |
| $TAE_{11}$ | 1.14 | 1.14 | 1.14 | 1.14 |
| Zeolite A | 19.65 | 19.65 | 19.65 | 19.65 |
| Citrate | 8.0 | 6.0 | 0 | 6.0 |
| MA/AA | 5.08 | 5.08 | 5.08 | 5.08 |
| Carbonate | 15.4 | 8.7 | 14.7 | 11.7 |
| Perborate Monohydrate | 12.5 | 12.5 | 12.5 | 12.5 |
| TAED | 5.0 | 5.0 | 5.0 | 5.0 |
| DETPMP | 0.59 | 0.59 | 0.59 | 0.59 |
| CMC | 0.83 | 0.83 | 0.83 | 0.83 |
| Suds Suppressor | 0.47 | 0.47 | 0 47 | 0.47 |
| Brightener | 0.25 | 0.25 | 0.25 | 0.25 |
| Photoactivated Bleach | 20 ppm | 20 ppm | 20 ppm | 20 ppm |
| Enzyme | 1.4 | 1.4 | 1.4 | 1.4 |
| Silicate(2.0 Ratio) | 3.5 | 0 | 0 | 0 |
| NaSKS-6* | 0 | 11.0 | 11.0 | 11.0 |
| Bicarbonate* | 0 | 0 | 0 | 3.9 |
| Citric acid* | 0 | 0 | 4.45 | 0 |

*Present as components of crystalline layered silicate particulates prepared in a similar manner to the particulate compositions in Example 1.

These formulations were used to carry out a test for fabric colour damage using the following protocol:

The formulations were subjected to a full scale washing machine test using Hotpoint automatic washing machines (Model 9534/9530)-setting Cycle 5 (non fast colours) at 40° C. Each machine was loaded with four cotton bedsheets (3.3 Kg) and 100 g of a particular formulation was added to the fabrics in the machine drum via a Flexi granulette dispensing device. Each fabric load also included a bleach-sensitive coloured fabric swatch of 43 cm×43 cm size made of 100% lambswool woven fabric with purple dye (Design No. W3970) supplied by Borval Fabrics, Albert Street, Huddersfield, West Yorkshire, England. 12 liters of water of 150 ppm hardness (expressed as $CaCO_3$) with a Ca:Mg ratio of 3:1 was fed to each machine.

In order to provide a stressed condition the fabric swatch was placed over the granulette and then twisted around its base to maintain the fabric in position around the granulette prior to the machine being started. 24 replicates of each treatment were performed and the swatches were then graded visually for fabric colour damage by an expert panel using the following grading system.

Three coloured swatches demonstrating differing degrees of colour damage are used as standards to establish a 4 point scale in which 1 represents 'virtually no damage' and 4 represents 'very damaged'. The three standards are used to define the mid points between the various descriptions of colour damage viz

| | |
|---|---|
| 1 | virtually no damage |
| 2 | slight damage |
| 3 | damage |
| 4 | very damaged |

Two expert panellists are used and their results are averaged to give an overall grade. When comparing the overall grades assigned a difference of 0.2 points is regarded as being a significant difference.

Using this technique to compare colour damage resulting from use of the formulations A,B,C & D the following results were obtained.

| formulation | Overall Grade |
|---|---|
| A | 1.2 |
| B | 1.8 |
| C | 1.4 |
| D | 1.2 |

Formulation B differs from A in the inclusion of crystalline layered silicate, the elimination of amorphous silicate and a reduction in the levels of citrate and carbonate builder in order to maintain parity of alkalinity. Formulation B demonstrates the fabric colour damage that is caused by the incorporation of crystalline layered silicate in an unprotected form.

It can be seen that Formulations C&D in accordance with the invention produce appreciably less fabric colour damage than Formulation B and approach Formulation A in their fabric colour damage impact.

EXAMPLE 3

Granular laundry detergent products of formulation generally similar to composition C of Example 2 were prepared and evaluated for fabric colour damage using the washing machine test technique set out in Example 2.

The products differed from composition C only in the amounts and methods of incorporation of citric acid and in the presence in some compositions of TAE50 or 45E8 nonionic as a binding or coating agent.

The compositions of the layered silicate particulates, their solution pH and the overall grades of colour damage provided by detergent compositions containing the particulates are shown below

| Product No. | Particulate composition (ingredient ratios) | Colour Damage Overall Grade | Particulate Composition pH (1%) |
|---|---|---|---|
| 1 | Reference (No. NaSKS-6*) | 1.2 | NA |
| 2 | NaSKS-6 + citric dry mixed 78/22 | 1.9 | 11.5 |
| 3 | NaSKS-6 + citric acid** 78/22 | 1.1 | 11.8 |
| 4 | NaSKS-6, citric acid, TAE50** (76/21/3) (Part neutralised) | 1.3 | 12.1 |
| 5 | NaSKS-6, citric acid, TAE50** (76/21/3) | 1.1 | 11.8 |
| 6 | NaSKS-6, citric acid, 45E8** (76/21/3) | 1.1 | 11.8 |
| 7 | NaSKS-6, coated (10% citric + 4% TAE50) | 2.0 | — |

*Composition A of Example 2
**Made by co compaction in accordance with the method of Example 1

Comparison of Product 2 with the reference Product 1 shows the increase in colour damage resulting from the incorporation of 11% NaSKS-6 as the silicate species without any attempt to provide an intimate mixture of the layered crystalline silicate with the citric acid. The reduction in colour damage provided by an intimate mixture of the layered crystalline silicate and the citric acid is shown by the Product 3–Product 2 comparison. Partial neutralisation of the citric acid under these conditions (Product 4) produces only a slight worsening of the colour damage relative to Product 3. Products 5 & 6 show that the presence of agglomeration aids does not affect the benefit provided by the intimate mixture of citric acid and crystalline layered silicate. Finally Product 7 demonstrates the inability of citric acid coating of NaSKS-6 by itself to reduce fabric colour damage under the conditions of the test.

We claim:

1. A particulate composition for use as, or as a component of, a solid laundry detergent composition, said particulate composition consisting essentially of:

a crystalline layered silicate material of the formula $NaMSi_xO_{2x+1}.yH_2O$ wherein M is sodium or hydrogen, x is a number from about 1.9 to 4 and y is a number from 0 to 20; and solid water ionisable material having a particle size not greater than about 300 micrometers, and being selected from the group consisting of ascorbic acid, citric acid, glutaric acid, gluconic acid, glycolic acid, succinic acid, tartaric acid, malic acid, maleic acid, malonic acid, oxalic acid, 1 hydroxy ethane 1, 1-diphosphonic acid, amino poly methylene phosphonic acids and mixtures thereof, the weight ratio of said silicate to said acid is about 3.5:1, and wherein said composition contains less than 5% by weight of unbound moisture, and said composition has a pH, measured on a 1% solution in 20° C. distilled water, of at least about 10, and said composition is manufactured by first mixing the silicate and the acid together so as to form an intimate, substantially uniform mixture, compacting the mixture in a roll compactor under the pressure under a pressure of about 10 to 50 kN per centimeter of roll width to form a flaked material, and comminuting said flaked material to provide a particulate dimension of no greater than 1200 micrometers.

2. A particulate detergent composition comprising:

a particulate composition according to claim 1; and from about 1% to about 50% by weight of a surfactant selected from the group consisting of anionic, nonionic, ampholytic and zwitterionic surfactants and mixtures thereof.

3. The composition of claim 1, wherein said silicate is present at a level from about 50 to 90 weight percent of the composition and said acid is present at a level from about 10 to 50 weight percent of the composition.

4. The composition of claim 3, wherein said silicate has the formula $\delta Na_2Si_2O_5$.

5. The composition of claim 4, wherein said silicate is present at a level from about 75 to 80 weight percent of the composition and said acid is present at a level from about 20 to 25 weight percent of the composition.

6. A particulate composition for use as, or as a component of, a solid laundry detergent composition, said particulate composition consisting essentially of:

a crystalline layered silicate material of the formula $NaMSi_xO_{2x+1}.yH_2O$ wherein M is sodium or hydrogen, x is a number from about 1.9 to 4 and y is a number from 0 to 20;

solid water ionisable material having a particle size not greater than about 300 micrometers, and being selected from the group consisting of ascorbic acid, citric acid, glutaric acid, gluconic acid, glycolic acid, succinic acid, tartaric acid, malic acid, maleic acid, malonic acid, oxalic acid, 1 hydroxy ethane 1, 1-diphosphonic acid, amino poly methylene phosphonic acids and mixtures thereof, the weight ratio of said silicate to said acid is about 3.5:1, and from about 1% to about 20% by weight of at least one binder agent selected from the group consisting of $C_{10}$–$C_{20}$ EO 5–100 alcohol ethoxylates, polyvinylpyrrolidones of molecular weights from about 12,000 to 700,000, polyethylene glycols of molecular weights from about 600 to 10,000, copolymers of maleic anhydride with ethylene, methylvinyl ether, or methacrylic acid, $C_{10}$–$C_{20}$ mono and diglycerol ethers, $C_{10}$–$C_{20}$ fatty acids, cellulose derivates, and homo and copolymers of polycarboxylic acids; and wherein said composition contains less than 5% by weight of unbound moisture, and said composition has a pH, measured on a 1% solution in 20° C. distilled water, of at least about 10, and said composition is manufactured by first mixing the silicate and the acid together so as to form an intimate, substantially uniform mixture, compacting the mixture in a roll compactor under the pressure under a pressure of about 10 to 50 kN per centimeter of roll width to form a flaked material, and comminuting said flaked material to provide a particulate dimension of no greater than 1200 micrometers.

7. A particulate detergent composition comprising:

a particulate composition according to claim 6; and from about 1% to about 50% by weight of a surfactant selected from the group consisting of anionic, nonionic, ampholytic and zwitterionic surfactants and mixtures thereof.

* * * * *

UNITED STATES PATENT AND TRADEMARK OFFICE

CERTIFICATE OF CORRECTION

PATENT NO. : 5,540,855

DATED : July 30, 1996

INVENTOR(S) : Baillely et al.

It is certified that error appears in the above-indentified patent and that said Letters Patent is hereby corrected as shown below:

Column 23, line 54, change "," to -- ; --.

Column 23, line 54, delete "wherein said composition".

Column 23, line 55, insert "wherein said composition".

Column 24, line 34, change "," to -- ; -- after "3.5:1".

Column 24, line 34, delete "from about 1% to about 20% by".

Column 24, line 35, insert " from about 1% to about 20% by".

Signed and Sealed this

Eighth Day of July, 1997

Bruce Lehman

*Attest:*

BRUCE LEHMAN

*Attesting Officer*

*Commissioner of Patents and Trademarks*